US005213656A

United States Patent [19]

Lis et al.

[11] Patent Number: 5,213,656

[45] Date of Patent: May 25, 1993

[54] METHOD OF USING A WEB FOR ETCHING OF A SURFACE

[75] Inventors: Brian H. Lis, West Hartford; William J. Stevenson, III, Somers; Raymond J. MacQueen, Jr., Canton; William T. Chase, Ellington; James R. Parys, Wallingford, all of Conn.; Alden J. Hay, Holden, Mass.

[73] Assignee: Gerber Scientific Products, Inc., Manchester, Conn.

[21] Appl. No.: 802,260

[22] Filed: Dec. 4, 1991

[51] Int. Cl.[5] ..... B44C 1/22; B44C 1/24

[52] U.S. Cl. ..... 156/630; 156/234; 156/238; 156/252; 156/267; 204/129.65

[58] Field of Search ..... 156/234, 231, 230, 238, 156/252, 253, 630, 631, 209, 219, 220, 267, 625; 204/129.65

[56] References Cited

U.S. PATENT DOCUMENTS

| | | | |
|---|---|---|---|
| 1,362,159 | 12/1920 | Weeks | 204/129.65 |
| 2,463,711 | 3/1949 | Nagle | 204/129.65 |
| 4,045,312 | 8/1977 | Satoshi | 204/129.65 |
| 4,467,525 | 8/1984 | Logan et al. | 83/879 |
| 4,994,131 | 2/1991 | Edwards | 156/234 |
| 5,026,584 | 6/1991 | Logan | 156/234 |

*Primary Examiner*—Jill L. Heitbrink

*Attorney, Agent, or Firm*—McCormack, Paulding & Huber

[57] ABSTRACT

A laminated web is used for etching characters, symbols or other shapes initially scribed in a layer of stencil sheet material including one of the layers of the web and the scribed stencil sheet is subsequently separated from the remaining web and used in an electrochemical etching process. The web is adapted to be used in an automatic sign maker wherein it is scribed on automatically as a result of instructions issued from a controller and the scribed markings are then used as a negative image in the etching process of an article surface.

13 Claims, 7 Drawing Sheets

METHOD OF USING A WEB FOR ETCHING OF A SURFACE

BACKGROUND OF THE INVENTION

This invention relates to a laminated web for marking characters, symbols and the like to an article surface and deals more particularly with a web usable in such a process whereby markings are made on an article surface in an electrolytic etching process.

In the past, it has been known that etching on a metal surface can be done through an electrolytic process using a hand-prepared stencil on which the desired shape or symbol to be transferred is created. In such known processes, creating the character or symbol to be transferred was accomplished either by hand scribing it or using a regular impact type typewriter to imprint on the stencil a given character or symbol. Among the several drawbacks associated with using such previously known etching techniques was that varying style and font size could not be easily achieved except by making time consuming changes to the equipment being used, such as for example, changing the impacting head of the typing machine. The ability to create characters or symbols that are custom sized and stylized to the article to be etched is important because not all articles are alike sizewise or even in terms of style. Often it is found that a character size offered in a standard typewriter is larger than the surface onto which it is to be applied. This presents a need for a system whereby font sizes and shapes can be readily varied in accordance with the size of the surface presented on the article on which the etching occurs. Also, it has been found that where a conventional typewriter is used to create characters on a stencil patch, the impacting of the typewriter head or hammer onto the stencil tended to produce blurred characters that do not have the best quality line definition. Moreover, it is often desirable when cataloging multiple articles, such as with tools in a machine shop, to be able to streamline this procedure using computer automation, whereby a program determines a suitable font size for the articles to be marked further decreasing the time involved in such a process.

Accordingly, it is an object of the present invention to provide a laminated web suitable for use in an automated scribing machine wherein the machine scribes on a layer of the web comprised of a stencil sheet which can ultimately be used in an electrochemical etching process to etch characters, symbols or the like on a surface to be marked.

Another object of the present invention is to provide a web of laminated material and method of using the same whereby the process of creating a graphic inscribed on the stencil sheet of a web of the aforementioned type is readily accomplished by marking the stencil sheet with the tool of an automated sign generator in accordance with instructions issued by its computer.

A further object of the present invention is to provide an inexpensive software based system for creating graphics in a web for etching them onto surfaces of articles which may vary in size and in shape.

Other objects and advantages will become obvious form the foregoing specification and the appended claims.

SUMMARY OF THE INVENTION

A method for etching a surface comprises the steps of providing an automated sign making machine having a pressure tool moveable transversely to the direction of flow of material movement over a support surface; providing a laminated web of material having a base layer of sheet material having first and second faces, a layer of stencil material in sheet form having a displaceable transferrable impregnated material therein and being superimposed on the base layer and having a first face facing the base and a second face facing away from the base layer, and a cover layer of material in sheet form overlaying the stencil sheet second face the cover layer having a first face facing the stencil sheet and a second face facing away from the stencil sheet; scribing the web by advancing it through the sign making machine such that the base layer first face is supported by the machine support surface and the cover layer second face is contacted by a pressure tool to laterally displace or to transfer impregnated material onto the base layer second face from the stencil sheet; separating the stencil sheet from the remaining layers of the web after scribing is completed; placing the stencil sheet onto a metallic surface to be marked such that the scribed-on portion overlays the surface; providing a voltage potential between the surface to be marked and a source disposed outwardly thereof; providing a medium for selectively conducting the electropotential through the stencil; and applying the medium to the web and allowing the medium to communicate through the stencil and react along portions of the article surface directly underlying the portions of the stencil in which the impermeable impregnation has been removed by the scribing process.

The invention further resides in a laminated web for use in the above process wherein the web comprises a base layer of sheet material having first and second faces and a layer of stencil material in sheet form having a soft liquid impervious material impregnated therein, the stencil layer being superimposed on the base layer and having a first face facing the base layer second face and a second face facing away from the base layer. The web further includes a cover layer of sheet material having a first face facing the second face of the stencil sheet and a second face outwardly disposed therefrom and means securing each of the cover and the stencil sheets against movement relative to the base layer. Means are also provided along marginal edge portions along each side of the base layer for driving the laminated web through machine. The base layer second face have means for effecting high definition transfer of the liquid impervious material onto it or for laterally displacing the impregnate on the stencil with the application of a pressure tool action through the cover sheet and against the base layer.

DETAILED DESCRIPTION OF THE PREFERRED EMBODIMENTS

Figure 1A:
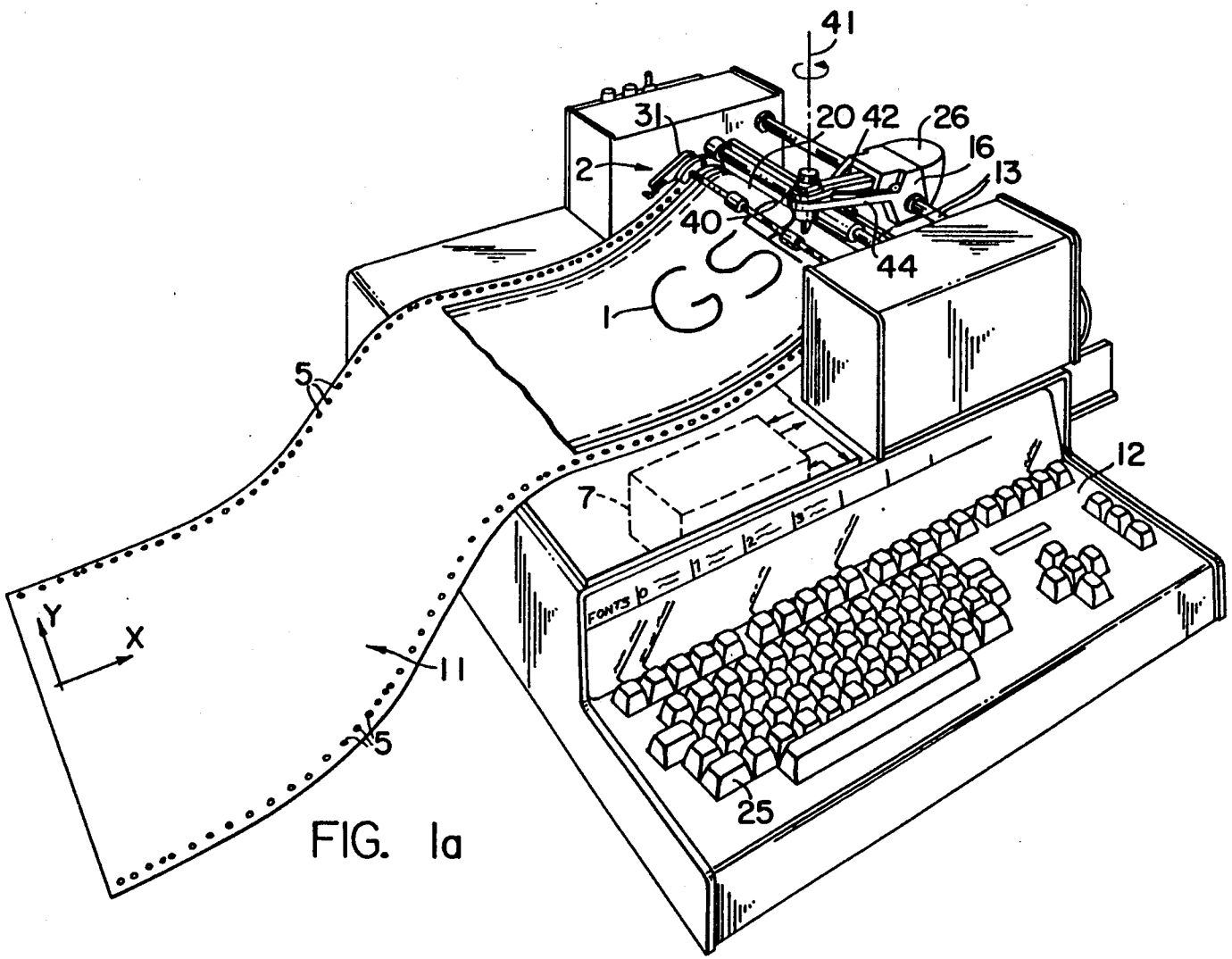
FIG. 1*a* is a perspective view showing a laminated web embodying the invention wherein the stencil layer is in the process of being drawn by an automated sign making machine.
Figure 1B:
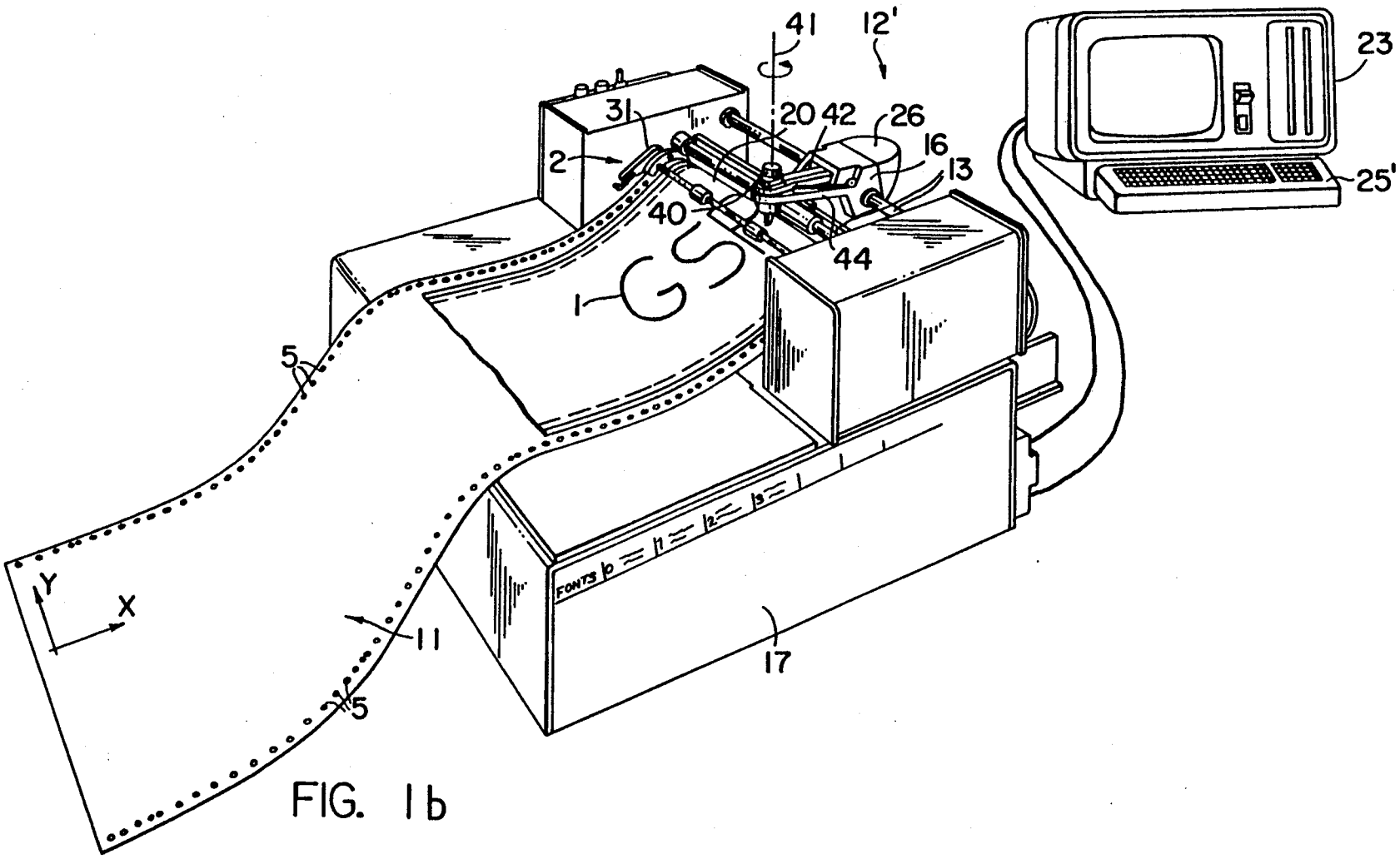
FIG. 1*b* is a perspective view showing a laminated web embodying this invention wherein the stencil layer is in the process of being drawn on by a machine comprised of a plotter and a personal computer.

In FIG. 1, a web embodying the invention is illustrated as 11 and is shown in the process as being scribed upon by a tool of an automated sign generating machine 12. The machine may be generally similar to that shown in U.S. Pat. No. 4,467,525 to which reference may be made for further details of its construction. The web 11 is moved through the machine 12 longitudinally of itself in the illustrated X coordinate direction by material advancing means 2 across a work surface which in the illustrated embodiment is defined by a roller 20. A tool head 16 is supported and driven by appropriate motor means (not shown) in the illustrated Y coordinate direction on ways 13 extending transversely relative to the web 11. The machine 12 further includes a controller 7 having a microprocessing unit linked to a memory means and a keypad interface 25 for instructing the controller 7 to move the web 11 relative to the tool head 16 to cause a graphic 1 to be formed in the web 11. Alternatively, as shown in FIG. 1*b*, the machine 12' may be comprised of a plotter 17 connected to a mass storage device having a separate controller, such as a personal computer 23, in which data controlling coordinated movements of the web 11 and the tool head 16 is stored for instructing the machine 12' to create a graphic 1 or a number of such graphics in the web 11. To this end, the arrangement of FIG. 1*b* is particularly well suited for automatically creating successive graphics in the web 11 each capable of differing both in size and shape in accordance with preprogrammed instructions stored in memory.

Figure 2:
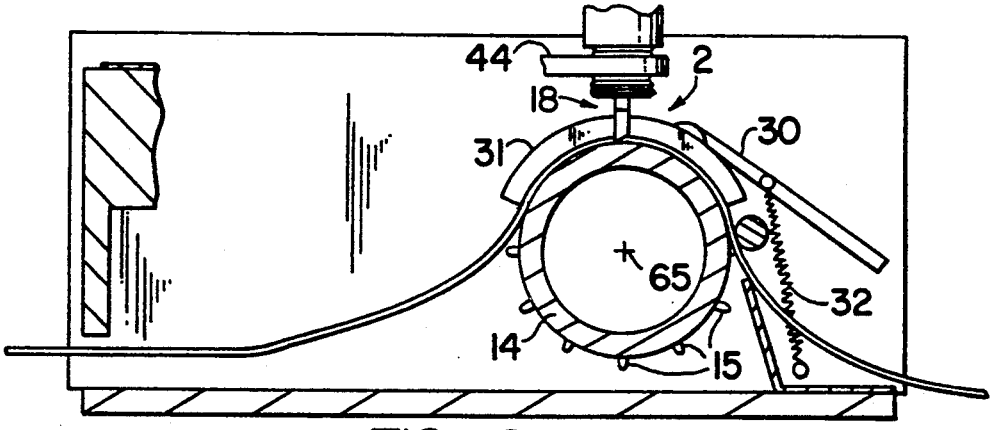
FIG. 2 is a partially fragmentary side sectional view showing a laminated web as it is driven in advancement through the machine of FIG. 1*a* and FIG. 1*b*.

Referring now to FIG. 2 and in particular to the advancing means 2 used for controlled movement of sections of sheet material though the machine 12, it will be seen that the advancing means includes two sprockets 14,14 located on laterally opposite sides of the web and rotatably driven by appropriate motor means about a common axis of rotation 65 in response to instructions issued by the controller 7. The sprockets 14,14 are spaced apart from one another by approximately the width of the web 11 and have a series of circumferentially disposed teeth or pins 15,15 projecting radially outwardly from the axis 65. The pins 15,15 are received within a series of openings 5,5 extending along either side edge of the web 11 in order to effect positive movement of the web 11 through the machine 12. Each of the sprockets has an associated arcuate clamp 31 and connected pivotal support arm 30 biased toward the sprocket by a spring 32 drawing the clamp against the sheet material being pulled. The arcuately shaped guide clamps 31,31 each has an internal groove straddling the sprocket pins allowing the pins 15,15 to rotate through the clamps while nevertheless allowing each clamp to apply a holddown force necessary to keep the sheet material in registration with the sprockets. It should be understood that alternatively it is well within the scope of the invention to substitute a friction drive for the sprocket system using two spaced apart sets of opposed wheels that engage marginal side edge portions of the web.

Figure 3A:
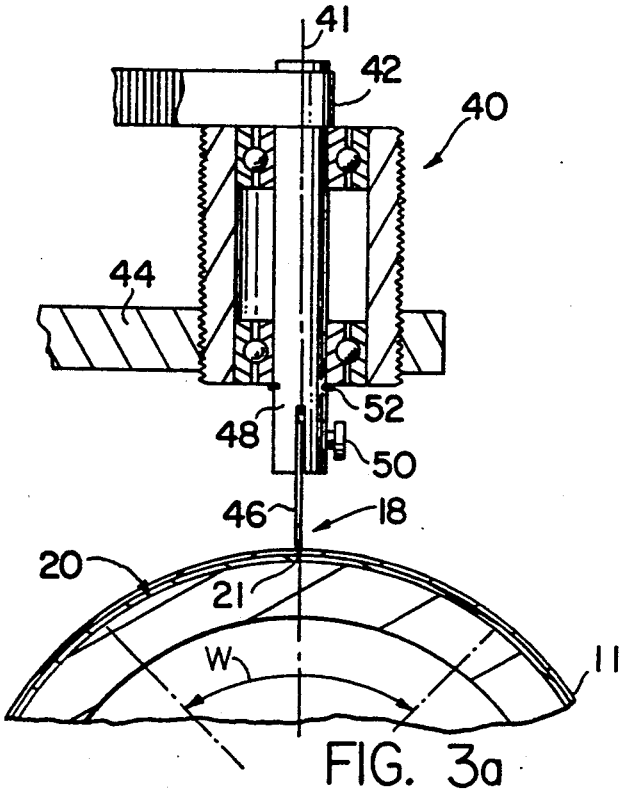
FIG. 3*a* is a partially fragmentary enlarged side elevational view of one type of tool used to create the graphics in the stencil layer of the web.

As seen more particularly in FIG. 3*a*, the tool head 16 carries a tool holder 40 and an associated pressure tool 18 having a blunt tip 21 engageable with the web 11 and rotatable relative to the head about an axis 41 oriented substantially vertically when the too head is in the working position above the web 11 as illustrated in FIG. 1. To effect rotation of the tool holder 40 about the theta axis 41, a drive belt 42 is employed to rotatably couple the tool holder 40 to a motor carried by the tool head 16 responsive to commands issued by the controller 7. The tool head is pivotally mounted on the way 13 such that the tool holder 40 is cantilevered outwardly therefrom by an arm 44 allowing the holder and its associated tool to be normally urged downwardly toward the web 11 by gravity. For adjusting the amount of downward force, an adjustable spring mechanism or other suitable pressure limiting means 26, such as a counterweight, is provided for varying the amount of downward pressure applied to the sheet material by the tool holder.

Figure 3B:
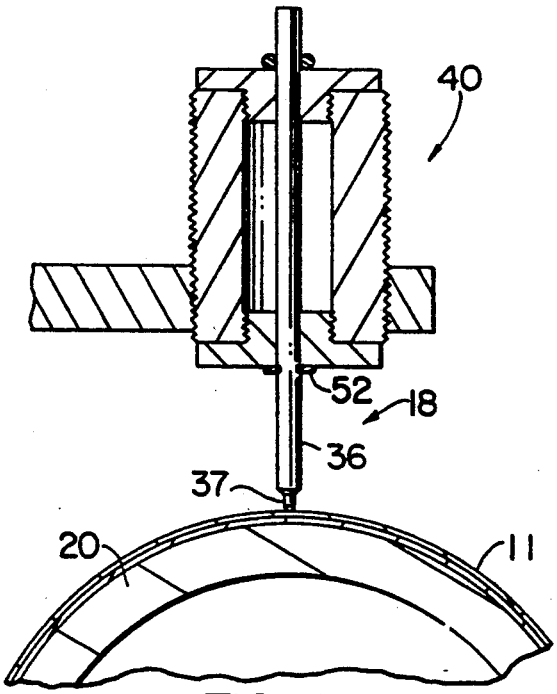
FIG. 3*b* is a partially fragmentary enlarged side elevational view of another tool type used to create the graphic in the stencil layer of the web.

In the illustrative example of FIG. 3*a*, the tool holder 40 has a chuck 48 for holding the "pressure tool 18 for movement above the web 11 at the apex of the roller 20. In this example, the cutting tool 46 is a small blade having a dulled leading edge 78 and a blunt tip 21 at its depending end and is clamped to the chuck 48 by means of a clamping screw 50 at its generally flat upper end. The chuck 48 and the associated cutting tool 46 are prevented from moving axially upwardly relative to the arm 44 by a detent ring 52 received within a circumaxial groove formed in the chuck 48. In the illustrated example of FIG. 3*a*, the chuck 48 is shown rotatably coupled by the belt 42 for the purpose of more distinctly positioning the leading edge 78 along a desired line angularly different from that which was previously drawn. Alternatively, as shown in FIG. 3*b*, the pressure tool 18 may take the form of a pen 36 having a tip 37 supported over the roller 20 on the tool holder 40, but which implement is not rotated about the theta axis 41 in the manner previously disclosed with reference to the embodiment of FIG. 3*a*. It being noted that the term "scribing" as used herein refers to the process whereby the pressure tool applies an imprinting force to the web enough to displace impregnate in the stencil along a line or point underlying the tool and does not necessarily refer to using an inking implement, such as the pen 36, to draw on the web. Regardless of the type of implement used for the tool 18, it should further be appreciated that when the roller 20 is provided as the support on which scribing occurs, the web 11 rests on at least a ninety degree wrap W, which contributes to the enhanced scribing of the web.

Figure 4:
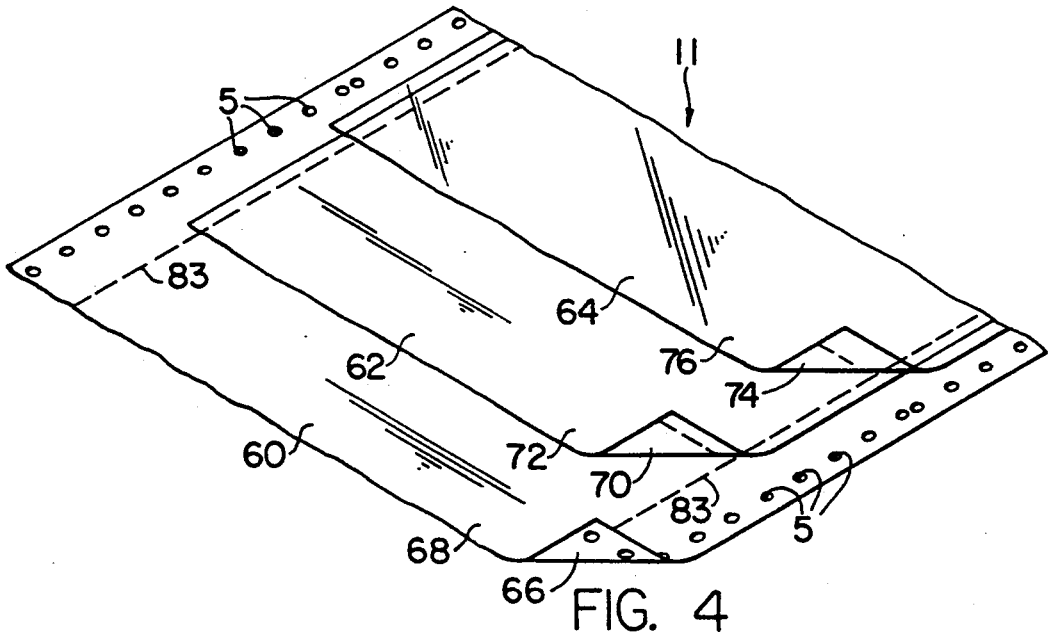
FIG. 4 is a perspective view of a portion of the web of FIG. 1 with parts of various layers be shown broken away to reveal the underlying layers.

Referring now to FIGS. 4 and 5, the laminated web 11 of FIG. 1 is made in accordance with the invention. The web is comprised of a base or carrier sheet 60 and a superimposed layer or sheet of stencil material 62. Further, the web has a cover layer 64 which aids in distributing pressure in the scribing process. The materials selected for the sheets 60, 62 and 64 may vary, but in the preferred case the carrier sheet 60 is made from a relatively heavy paper of 80 pound stock having a thickness of about 8 to 10 mils. The stencil sheet is one of any number of commonly available commercial stencil products having a permeable hemp or tissue base impregnated with a liquid impermeable material, such as colored soft wax. The material making up the cover sheet 64 can be one selected from any suitable type of material having properties which allow the pressure tip of the tool 18 to slide readily over the web to effect even distribution of the downward force applied, and in the preferred embodiment of the invention, the cover sheet 64 is formed from a thin sheet of MYLAR having a thickness of less than 1 mil.

As shown, the base layer 60 has a first face 66 and a second face 68; and the stencil layer 62 has a first face 70 and a second face 72. The first face 6 of the base layer 60 faces and confronts the roller 20 of the machine or other support surface which may be used, and its second face 68 faces and confronts the first face 70 of the stencil material sheet 62. The cover layer 64 has a first face 74 facing the second face 72 of the stencil sheet and has an oppositely outwardly disposed second face 76 facing outward and being disposed for scribing on by the pressure implement 18. When paper sheet material is used for the base layer sheet 60 in accordance with the method of the invention, the second face 68 is provided with a highly smooth texture and possesses a desired absorbency characteristic enabling the impregnate in the stencil sheet 62 constituting the scribed character to be readily transferred to the surface 68 upon the application of suitable pressure from the tool 18. This feature insures the creation of lines having high definition. For this purpose, the surface 68 in the case where the sheet 60 is paper, may be provided with a coating, such as one formed from clay.

Figure 5A:
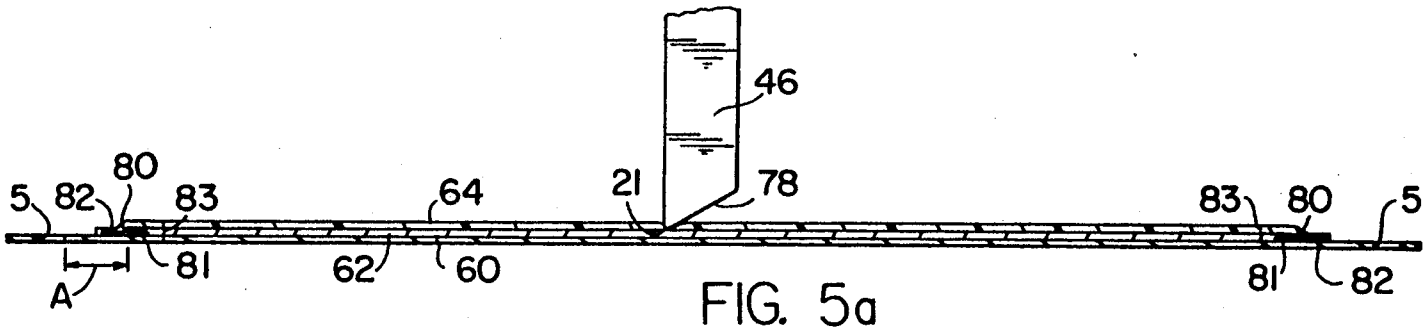
FIG. 5*a* is a sectional view taken through the web of FIG. 1 transversely of its length wherein the thickness of the various layers have been exaggerated for clarity, the view showing the pressure implement at work during marking of the stencil layer.

To effect registration between each of the sheets that make up the web 11 as best seen in FIG. 5*a*, the stencil sheet 62 is attached along its marginal side edge portions 80,80 to the underlying second surface 68 of the base layer 60 by a suitable means such as by an acrylic adhesive. The adhesive strips 81,81 are each approximately one quarter inch wide and do not interfere with the work area provide on the stencil. Widthwise, the stencil sheet itself extends transversely of the web, but the side edges thereof are each spaced from the rows of feed openings 5,5 by the indicated dimension A. The cover sheet 64 is widthwise sized to completely overlay the stencil sheet 62 in a transverse direction, but only partially cover the base sheet 60. The marginal side ends of the cover sheet 64 extend within the space marked A and are secured to the base layer 60 through the intermediary of like adhesive strips 82,82 so as not to interfere with the work area on the stencil or to cause any interference with the feed openings 5,5 or any marginal side portions which may be used in lieu of such openings to drive the web through the machine.

For readily separating the stencil sheet layer 62 from the base layer 60 which supports it during the scribing operation, both the cover and the stencil sheets are scored along longitudinally extending lines 83,83 disposed transversely inwardly of the securements where each remaining sheet attaches to the base layer 60. The score lines 83,83 are made generally intermittently through both the stencil and cover sheets 62 and 64 and are formed in the material in such a manner as to allow the cover and the stencil sheets to be manually torn away from the underlying base layer after the scribing process is complete, but nevertheless allow the stencil and cover sheets to remain attached to the underlying base layer 60 during the scribing operation as the web is advanced through the machine 12.

Figure 5B:
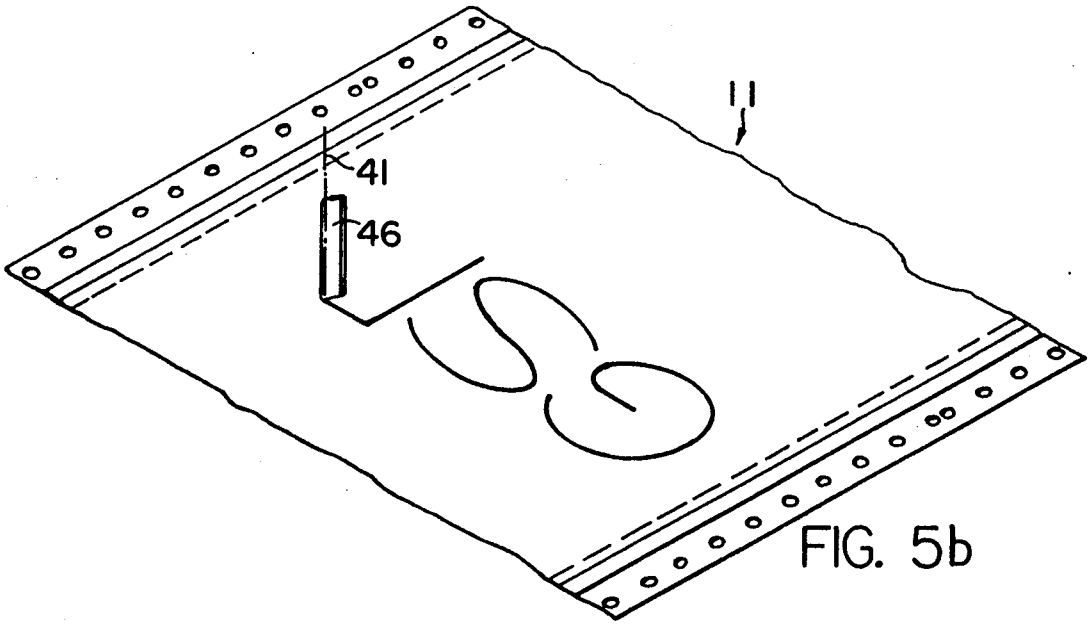
FIG. 5*b* is a perspective view of a portion of the web of FIG. 1 showing theta control of the pressure implement of FIG. 3*a*.

The pressure tool 18 when brought to bear on the upper surface 76 of the web 11 moves along in a desired path in accordance with directional vectors defined by the controller 7. In the embodiment of FIGS. 5*a* and 5*b*, a knife blade 46 having a blunt tip 21 and a dulled leading edge 78 bears down on the web with an appropriate pressure applied by the counter pressure means 26 such that the knife engages along the cover layer upper surface 76 and slides therealong without perforating the cover layer, yet has a suitable downward force to transfer the stencil impregnate onto the second surface 68 of the base sheet 60. This process is further aided as illustrated in the FIG. 5*b* by employing the theta control capability of the machine 12 in conjunction with the web advancement controls to create sharp corners and improved scribing quality in the characters or shapes being formed.

Figure 6:
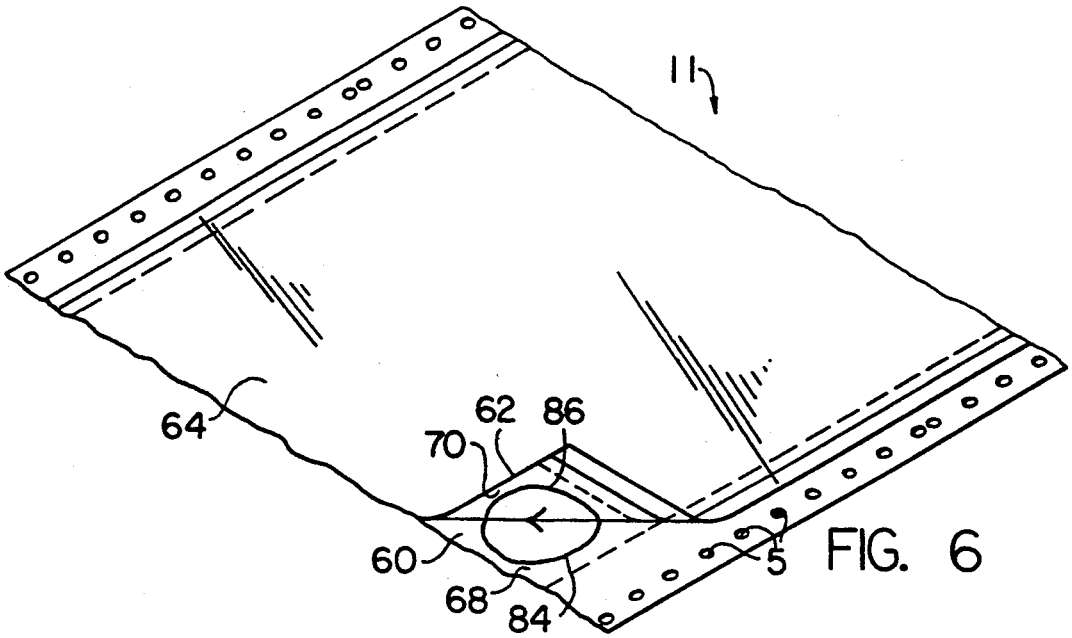
FIG. 6 is a perspective view of a portion of the web of FIG. 1 showing an imprinted character on the underlying base sheet as the stencil layer is separated.

As shown in FIG. 6, the character indicated at 84 is shown imprinted on the upper surface 68 of the base sheet 60. This is the result of the pressure tool 18 bearing down on the stencil sheet 62 and causing the impregnation to be forced onto the surface 68 leaving a negative image of the character herein shown at 86 remaining with the stencil. The negative image of the character 86 is what is ultimately used to effect the etching process as will be seen with reference to FIGS. 7 through 9. The now scribed stencil 62' and associated cover sheet are together separated from the base sheet 60 by pulling and tearing them along the score lines 83,83. The score lines 83,83 allow such separation to occur even with the base layer engaged within the machine 12 thereby eliminating the need to reload the web after every job. Thereafter, the stencil sheet 62' is peeled from the cover layer 64 so that the stencil sheet may itself be applied directly to the article surface to be marked.

Figure 7:
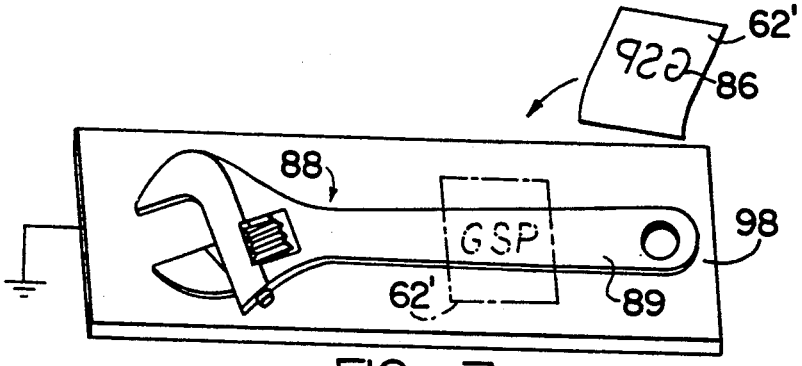
FIGS. 7 through FIG. 9 are views showing the sequence of steps followed in using the stencil to create an etching on an article surface.
Figure 8:
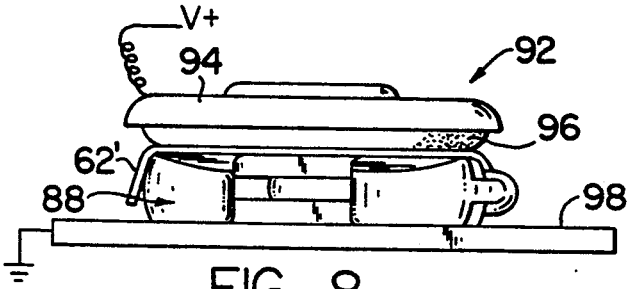
Figure 9:
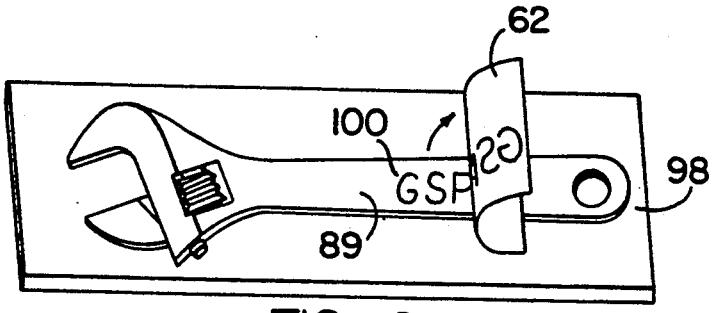

In the illustrated example of FIG. 7, the surface 89 to be marked is that of a tool 88 having a metallic substantially planar portion suitable for marking, but it should be understood that the application of this process is not limited to such planar surfaces, and may include marking an irregular or curved surface. A conventional standard marker head 92 and grounding means 98 are provided to effect etching. The marker head 92 has a holder 94 housing an absorbent sponge-like medium 96 wetted with a suitable commercially available electrolyte. A voltage potential is provided and is introduced between the surface to be marked and the marker head 92 in the following manner. The article to be marked is placed onto the grounding means 98 shown in this case as a plate, or may alternatively be connected to ground by a clip. Then the scribed on stencil sheet 62' is placed over the article to be etched such that the negative image of the characters to be transferred overlays the surface to be marked as shown in phantom line in FIG. 7. With the voltage potential applied, the marker head is brought into contact with the stencil 62' and pressed down onto it for a few seconds allowing the charged electrolyte to communicate only through portions of the stencil sheet where the impermeable impregnate is removed. Thereafter, the electric potential may be turned off, the marker head 92 pulled away from the article 88, and as seen in FIG. 9, the stencil 62' removed leaving the desired marking 100 electrochemically etched onto the surface 89.

Figure 10:
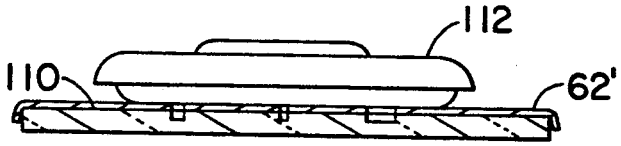
FIG. 10 is a view showing an alternate embodiment of the etching process.

From the foregoing, a novel method and related web for etching a graphic onto a surface has been disclosed. However, numerous modifications and substitutions can be made without departing from the spirit of the invention. For example, it may be well within the purview of the invention to use a highly fine grade of paper for the base layer 60 in the web that itself possesses an inherent smoothness suitable for high definition transfer of the impregnate and thereby eliminate the need to provide a coating on the second surface 68 to effect this result. Also, in the preferred embodiment, the scribed stencil sheet 62' is disclosed in an electrolytic etching process, but it is nevertheless contemplated to use the scribed stencil sheet 62' as a suitable resist in creating graphics on a surface which is not electrically conductive. For example, as shown in FIG. 10, the surface 110 may be one of a glass article, and the marker head 112 may be one capable of holding a corrosive liquid, such as hydrofloric acid, which is applied to the surface 110 through portions of the stencil sheet 62' where the impregnate has been removed or displaced by the scribing process. The corrosive action may subsequently be arrested once a desired impression has been made in the article by applying, for example, lime to the affected areas.

Accordingly, the present invention has been described by way of illustration rather than by way of limitation.

We claim:

1. A method for etching a surface comprising the steps of:

providing an automated sign making machine having a pressure tool moveable relative to the direction of flow of material movement over a support surface;

providing a laminated web of material having a base layer of sheet material having first and second faces, a layer of stencil material in sheet form having a displaceable transferrable impregnated material therein and being superimposed on said base layer and having a first face facing said base layer second face and a second face facing away from said base layer, and a cover layer of material in sheet form overlaying said stencil sheet second face, said cover layer having a first face facing the stencil sheet and a second face facing away from the stencil sheet;

scribing said web by advancing it through said sign making machine such that said base layer first face is supported by said machine support surface and said cover layer second face is contacted by said pressure tool to displace said impregnated material from the portion of said stencil sheet underlying said pressure tool where said scribing occurs;

separating said stencil sheet from the base layer and the cover layer of said web after scribing is complete;

placing said stencil sheet onto a surface to be marked such that the scribed-on portion overlays the surface;

providing a voltage potential between the surface to be marked and a source disposed outwardly thereof;

providing a medium for selectively conducting said electropotential through said stencil; and applying the medium to the web and allowing said medium to communicate through said stencil and react along portions of the article surface directly underlying the portions of the stencil in which the impermeable impregnation has been removed by the scribing process.

2. A method as defined in claim 1 further characterized by providing said pressure tool as a knife having a blunt tip and a dulled leading edge.

3. A method as defined in claim 2 further characterized by holding said knife on a controllable rotatable mount such said knife rotates about a theta axis; and rotating said knife about said theta axis when a character or shape being scribed involves moving said knife through a turn or angle.

4. A method as defined in claim 3 further characterized by providing said web with marginal side edge portions along which a series of correspondingly sized and laterally spaced openings are formed;

providing an advancing means in said machine to coact with said web to positively drive said web through said sign making machine.

5. A method as defined in claim 4 further characterized by providing said support surface in the form of a roller and advancing said web through said machine on said roller such that said web rests along a 90 degree portion thereof.

6. A method as defined in claim 5 further characterized by providing said second face of said base layer with a smooth finish and causing said knife edge to separate the impermeable impregnate from the remainder of said stencil along distinct lines.

7. A method as defined in claim 1 further characterized by providing said pressure implement as a ball point pen.

8. A method as defined in claim 7 further characterized by bonding said layer of stencil material and said cover sheet such that each is bonded to the base layer along peripheral side edges thereof; and forming score lines in each of said cover sheet and said stencil sheet such that said cover and stencil sheets remain attached to said base layer during a scribing operation yet are readily separable from the base sheet by manually tearing them along said score lines.

9. A method as defined in claim 2 further characterized by bonding said layer of stencil material and said cover sheet layer to the base layer along peripheral side edges thereof to define securement areas there along;

providing score lines extending longitudinally of said web in each of said cover sheet and said stencil sheet and locating each line laterally inwardly of the securement areas between said base layer and said cover and said stencil sheets; and selecting said score lines such that said cover sheet and said stencil sheet remain attached to said base layer during a scribing operation yet are readily separated from the base sheet by manually tearing them along said score lines while said base sheet remains engaged within said machine.

10. A method as defined in claim 2 further characterized by providing said impermeable impregnate as a soft wax material.

11. A method as defined in claim 7 further characterized by providing said impermeable impregnate as a soft wax material.

12. A method as defined in claim 10 further characterized by providing an electrolyte as said medium.

13. A method as defined in claim 11 further characterized by providing an electrolyte as said medium.

* * * * *